US010669076B2

(12) United States Patent
Van Der Molen

(10) Patent No.: US 10,669,076 B2
(45) Date of Patent: Jun. 2, 2020

(54) CLOSURE ASSEMBLY AND CONTAINER PROVIDED WITH SUCH A CLOSURE ASSEMBLY

(71) Applicant: Scholle IPN IP BV, SX Tilburg (NL)

(72) Inventor: Peter Jan Van Der Molen, SX Tilburg (NL)

(73) Assignee: SCHOLLE IPN IP BV, Tilburg (NL)

( * ) Notice: Subject to any disclaimer, the term of this patent is extended or adjusted under 35 U.S.C. 154(b) by 0 days.

(21) Appl. No.: 16/325,499

(22) PCT Filed: Aug. 14, 2017

(86) PCT No.: PCT/NL2017/050533
§ 371 (c)(1),
(2) Date: Feb. 14, 2019

(87) PCT Pub. No.: WO2018/034562
PCT Pub. Date: Feb. 22, 2018

(65) Prior Publication Data

US 2019/0193899 A1 Jun. 27, 2019

(30) Foreign Application Priority Data

Aug. 18, 2016 (NL) ..... 2017333

(51) Int. Cl.
*B65D 41/47* (2006.01)
*B65D 75/58* (2006.01)
*B65D 41/34* (2006.01)

(52) U.S. Cl.
CPC ..... *B65D 41/47* (2013.01); *B65D 41/34* (2013.01); *B65D 75/5883* (2013.01); *B65D 2101/0061* (2013.01); *B65D 2575/586* (2013.01)

(58) Field of Classification Search
CPC .... B65D 41/34; B65D 41/47; B65D 75/5883; B65D 2101/0061; B65D 2575/586
See application file for complete search history.

(56) References Cited

U.S. PATENT DOCUMENTS

2010/0213213 A1* 8/2010 Albers ..... B65D 41/3409 222/153.05
2015/0129533 A1* 5/2015 Taber ..... B65D 75/5883 215/252
2018/0201415 A1* 7/2018 Berge ..... B65D 75/008

FOREIGN PATENT DOCUMENTS

EP 0387302 A1 9/1990
EP 1940699 A1 7/2008
(Continued)

*Primary Examiner* — Frederick C Nicolas
(74) *Attorney, Agent, or Firm* — The Watson IP Group, PLC; Jovan N. Jovanovic

(57) ABSTRACT

In a closure assembly the cap is a quarter-turn cap and the bottom end of the skirt has a pair of diametrically opposed static cover portions separated from one another by a pair of diametrically opposed and open bottomed notches in the skirt. In each notch an indicator segment of the tamper-evident structure is located that is integrally molded to an upper notch rim by a non-frangible hinge, preferably a film hinge, and to each of the leading rim and the trailing rim via at least one respective frangible bridge. The neck has for each indicator segment an integrally molded boss adapted to engage on a respective indicator segment such that, upon first time opening of the cap by quarter turn rotation in opening direction, the indicator segments are each forced outwardly by the respective boss such that each of the indicator segments pivots about the non-frangible hinge and the frangible bridges break, thereby the outwardly pivoted indicator segments and the broken frangible bridges evidencing the first time opening of the cap.

18 Claims, 15 Drawing Sheets

(56) References Cited

FOREIGN PATENT DOCUMENTS

| | | | |
|---|---|---|---|
| EP | 2594504 | A1 | 5/2013 |
| FR | 2933385 | A1 | 1/2010 |
| WO | 2014187520 | A1 | 11/2014 |
| WO | 2015065481 | A1 | 5/2015 |
| WO | 2015181655 | A1 | 12/2015 |

* cited by examiner

CLOSURE ASSEMBLY AND CONTAINER PROVIDED WITH SUCH A CLOSURE ASSEMBLY

FIELD OF THE INVENTION

The present invention relates to a closure assembly and to a container, e.g. a collapsible pouch, provided with such a closure assembly.

BACKGROUND OF THE INVENTION

Closure assemblies are known with a plastic cap that is mounted onto a neck, e.g. of a container. A tamper-evident structure is integrally formed as a part of the plastic cap.

A closure assembly is known from EP 1940699.

The long hollow pin portion of this type of cap is considered, at least for packaging some substances, to provide one or more advantages in view of product shelf life. For example it is considered that by effectively blocking a major part, or all, of the length of the channel by means of a seal at the lower end of hollow pin, the barrier properties of the closure assembly are enhanced. There is a more effective barrier between the packaged substances on the one hand and oxygen in the ambient atmosphere on the other hand, compared to a more common cap design where the hollow pin is absent and substance is present in the product passage. For example the hollow pin portion avoids that packaged substance is collected in the channel, which substance might be prone to drying and/or discoloring, e.g. in case of easily perishable food substances.

Whilst such advantages may exist, presently existing design of the hollow pin type cap are still deemed not satisfactory, e.g. in view of production costs, consumer handling, tamper-evident quality.

For example the presence of internal threading in the neck of the article hinders the passage of substance through the passage. Also the provision of threading on the circumferential face of the hollow pin portion is problematic in view of injection molding of the cap.

Another disclosure of a cap with hollow pin portion is in WO2014/187520. Here the skirt is provided with internal threading and the neck with external threading. Due to the presence of the hollow pin portion that extends to the level of the tamper-evident the injection molding of such a cap is problematic.

OBJECT OF THE INVENTION

The present invention aims to provide an improved closure assembly with a cap of the hollow pin type, or at least to provide an alternative for known closure assemblies with this type of cap.

The present invention aims to provide a closure assembly, wherein one or more of the above issues are addressed, e.g. providing a design that can be manufactured effectively, a design that provides easy operation for the user, and provides a tamper-evident function that is very effective and reliable. Further aims of the present invention are enhanced barrier properties of the closure assembly.

SUMMARY OF THE INVENTION

The present invention achieves one or more of the above-mentioned objects by providing a closure assembly.

In the inventive closure assembly the cap is a quarter-turn cap, wherein the neck is provided with two integrally molded and diametrically opposed, outwardly protruding retention members for the cap, wherein the skirt of the cap is provided, in a region above the tamper-evident structure, with two diametrically opposed windows that each extend through the skirt, each embodied to receive a retention member therein so as to axially retain the cap on the neck.

The skirt of the cap has, at the level of said windows, a pair of diametrically opposed enlarged inner space portions each delimiting an inner space such that, upon quarter turn rotation of the cap in opening direction by a user, the enlarged inner space portions align with the retention members as the retention members each move out of the respective window.

The bottom end of the skirt has a pair of diametrically opposed static cover portions separated from one another by a pair of diametrically opposed and open bottomed notches in said skirt, each of said static cover portions forming a sector of a lower edge of the skirt and having a leading rim and a trailing rim, seen in opening direction of the cap, preferably each static cover portion having a semi-circular inner contour about the vertical axis of the neck, Each notch is defined by an upper notch rim and by the trailing rim of one of the static cover portions and the leading rim of the other of the static cover portions, In each notch an indicator segment of the tamper-evident structure is located, and each indicator segment is integrally molded to said upper notch rim by a non-frangible hinge, preferably a film hinge, and to each of said leading rim and said trailing rim via at least one respective frangible bridge.

Each indicator segment has an inner face, and the exterior side of the neck has for each indicator segment an integrally molded boss, said boss being engageable with the inner face of said segment.

Each boss is adapted to engage on said inner face of a respective indicator segment such that, upon first time opening of the cap by quarter turn rotation in opening direction, the indicator segments are each forced outwardly by the respective boss such that each of said segments pivots about said non-frangible hinge and said frangible bridges break, thereby said outwardly pivoted indicator segments and said broken frangible bridges evidencing the first time opening of the cap.

This arrangement allows for an easy, intuitive first time opening by the user. Also the outwardly and upwardly pivoting indicator segments at opposite sides of the cap, e.g. like a wing doors car, have a highly recognizable action and thus provide a highly reliable tamper-evident.

The cap can be effectively injection molded, especially as no threading is present on the hollow pin circumferential face and the interior of the skirt. This avoids the need for a rotary annular core member forming such threading that would have to be unspun for ejection of the molded cap from the injection mold. And due to the absence of such complex core member it is possible, as preferred, to mold the cap from a single gate at the bottom side of the closed bottom end of the pin, using a hot runner nozzle directly opening to said gate. So the melt flow will then flow from said bottom end of the hollow pin along the length of the pin portion and then via the annular top wall into the skirt. This allows for effective injection molding.

The design and operation of the injection mold for the cap is further facilitate by the windows for the retention members, which windows can be easily implemented in the molding process, as well as the design of the tamper-evident structure.

In an embodiment each indicator segment is elongated with a length in direction between said trailing and leading rim of the notch and a height, wherein the hinge is embodied as a film hinge which extends over a major portion, e.g. approximately over the entirety, of the length of the segment. The provision of a film hinge allows for effective production as well as creating a rather high pulling strength to which the segment can be subjected without any risk of the segment become separated.

In an embodiment the hinge, preferably embodied as film hinge, provides a pulling strength of at least 90N when subjected at 20° C., e.g. after first time opening of the cap, to a pulling force in the plane of the segment and perpendicular to the hinge.

In an embodiment each indicator segment is connected to each of the associated trailing leading rims via a single frangible bridge, e.g. formed each by a single frangible rod portion, e.g. located close to the lower edge of the respective static cover portion. For example each frangible rod portion or other bridge is located slightly inward from the exterior of the adjacent segment and cover portion, so as to avoid premature damage to the bridge.

In an embodiment the neck comprises a pair of integrally molded, diametrically opposed semi-circular flange members, each forming one of said bosses, wherein each flange member has a semi-circular outer perimeter, and wherein each static cover portion has a semi-circular inner perimeter fitting around said semi-circular outer perimeter of the flange member, e.g. wherein the semi-circular flange members have coplanar bottoms in a common radial plane and wherein said lower edge sectors formed by the static cover portions are located in said common radial plane. In this design the flanges radially stabilize the cover portions at their lower ends.

In an embodiment a rectilinear rib portion is present on top of each flange member, e.g. each flange member having planar bottom surface, e.g. in a common plane with lower edges of the static cover portions, wherein said rectilinear rib portions of the opposed flange members are parallel and extend over the width of the respective flange member so as to have rib ends of which one forms said boss and is located directly inward of a segment, e.g. directly inward of an end portion of a segment. This design affords a sturdy boss on the neck, in conjunction with support for the static cover portions of the cap skirt.

In an embodiment each indicator segment has a lower edge located in a common radial plane with lower edge sectors formed by the static cover portions.

In an embodiment each indicator segment has, at the exterior of the segment, a reinforcing rib portion extending along a lower edge of the segment. The reinforcement acts to enhance the breaking of the bridges at both ends of the segments as the boss presses against the inner face of the indicator segment.

In an embodiment the retention members each have an inclined ramp face and wherein said windows each have a mating inclined ramp face, so that upon rotating the cap in opening direction, said ramp faces cooperate and provide a lift action of the cap relative to the neck. This may, e.g. be advantageous when a snap fit feature is provided between the cap and the neck of the article.

In an embodiment the windows are arranged vertically above the indicator segments and the enlarged inner space portions of the skirt are located vertically above the static cover portions. This allows for a robust structure of the cap and a visually pleasing appearance.

In an embodiment the indicator segments are radially spaced further from the vertical axis of the neck than the windows arranged there above, and the skirt comprises an inner guide face in a region of its interior between the upper rim of the notch and the window there above, said inner guide face being upwardly and inwardly inclined thereby facilitating an axial snap fitting of the cap on the neck such that the retention member snaps into the window. As is preferred the cap is then vertically snapped onto the neck during assemblage of the assembly, e.g. after having filled a container through the product passage.

In an embodiment the cap has two diametrically opposed, substantially planar wing portions that extend outwardly from the skirt in an imaginary vertical plane through the vertical axis of the neck, said wing portions enhancing grip on the cap by a user and possibly enhancing anti-choke hazard properties of the cap. In an embodiment the pair of windows and the pair of indicator segments are located on diametrically opposed locations relative to said imaginary vertical plane through the wing portions of the cap.

In an embodiment of the optional flange members, when seen from above, each flange member extends over an arctuate sector of the neck with the semicircular outer perimeter thereof fitting within a matching semicircular static cover portion of the cap, wherein said flange members each extend to overlap with an end portion of an indicator segment only, so as to leave a central portion of the segment inwardly unsupported. Preferably a rod portion on top of each flange member forms an inward support for the indicator segment end.

In an embodiment the neck has at a top region thereof, above the retention members, an outer annular sealing surface that, in the closed position of the cap, sealing cooperates with an associated inner annular sealing surface at the interior of the skirt of the cap. This creates a seal between the skirt and the neck, e.g. to avoid undesired ingress of matter from the outside.

In an embodiment the hollow pin portion, near a top end thereof close to or adjoining the annular top wall of the cap, has an outer annular top sealing surface, e.g. of greater diameter than the lower portion of the hollow pin, and the neck has, at a top region thereof at top inner annular sealing surface that, in the closed position of the cap, sealing cooperates with said outer annular top sealing surface of the hollow pin.

In an embodiment, as preferred, the hollow pin portion, near the bottom end thereof close to or adjoining the bottom end, has an outer annular bottom sealing surface, and the article has a lower inner annular sealing surface that, in the closed position of the cap, sealing cooperates with said annular bottom sealing surface of the hollow pin portion. This allows for a seal at a low position in the product passage, possibly further enhanced by a seal as discussed near the top end of the hollow pin portion.

In an embodiment the article is a spout having a lower connector portion adapted to be secured between opposed film walls of a collapsible pouch container, and the product passage extends through said lower connector portion and aligned with said neck as a downward continuation thereof to a lowermost channel opening. Preferably the hollow pin seals the passage right at the lower end of the passage.

In an embodiment the lower connector portion comprises a downward depending annular lip that forms said lower inner annular sealing surface. This allows to tailor the resilience of the lip to achieve the desired sealing effect.

In an embodiment the lower connector portion has a bottom face and a recessed central region that lies higher than said bottom face, wherein said annular lip depends from said recessed central region, preferably at most till the level of the bottom face. Therefore the lip is sort of hidden and less prone to damage, e.g. in the course of handling the spout prior to assembly on a pouch.

In an embodiment the article is a container having a container body, wherein possibly the neck is integrally molded with the container body. For example the container is a blow molded plastic container.

In an embodiment the article is a fitment to be secured to a container body, e.g. the article is a spout, e.g. having a lower connector portion to be secured between opposed film walls of a collapsible pouch container.

The present invention also relates to a method for manufacturing a closure assembly as disclosed herein, comprising the steps of:

providing the article, injection molding the cap, securing the cap on the neck of the article, e.g. by snap fitting the cap in linear vertical motion onto the neck.

The present invention also relates to a method for manufacturing a closure assembly or cap for a closure assembly as disclosed herein, wherein the cap is injection molded in an injection mold having a single gate that is arranged on the bottom side of the cavity portion that forms the closed bottom end of the hollow pin portion of the cap.

The present invention also relates to a method for manufacturing a closure assembly or cap for a closure assembly as disclosed herein, wherein one or more injection molded caps are taken as samples from a batch, and wherein the indicator segments of said samples are moved to their outwardly and upwardly pivoted position, and wherein said indicator segments are subjected to a test load of 90N in a direction perpendicular to the hinge in the plane of the segment, optionally both in initially position of the segment (e.g. with the frangible bridges broken) and in said outwardly pivoted position, e.g. subjecting said indicator segments first to multiple pivoting motions prior to testing, and wherein said batch is discarded if said test is not met due to one or more indicator segments become separated from the cap.

A second aspect of the invention relates to a closure assembly comprising:

an article forming a tubular neck and having a product passage extending through said neck, said neck having a vertical axis and forming a mouth at a top end of said product passage, said neck having an interior side and an exterior side, a rotational cap having a unitary cap body that is injection molded of plastic material and that is secured on or to be secured on said neck of the article, the cap sealing the product passage in closed position of the cap on said neck, and the cap—for removal of the cap from the neck of the article by a user to open the product passage—being adapted to be manually rotated from the closed position in an opening direction, wherein the unitary cap body comprises an annular top wall having an inner perimeter and an outer perimeter, a downward depending skirt integral with said outer perimeter, and a hollow pin portion downward depending from said inner perimeter, said hollow pin portion having a circumferential face extending along a length thereof and a closed pin bottom, e.g. said hollow pin portion being open at a top thereof, wherein the circumferential face of the hollow pin portion and the article have at least one pair of cooperating sealing surfaces such that hollow pin portion, in the closed position cap, closes the product passage, wherein said skirt of the cap body has an interior side and an exterior side, wherein the cap furthermore comprises an integrally molded tamper-evident structure at the bottom end of the skirt which is adapted to evidence first time opening of the cap, wherein said hollow pin portion extends from the annular top wall downward at least to the level of the tamper-evident structure, characterized in that the cap is a quarter-turn cap, wherein the neck is provided with two integrally molded and diametrically opposed, outwardly protruding retention members for the cap, wherein the skirt of the cap is provided, in a region above the tamper-evident structure, with two diametrically opposed windows that each extend through the skirt, each embodied to receive a retention member therein so as to axially retain the cap on the neck, and wherein the skirt of the cap has, at the level of said windows, a pair of diametrically opposed enlarged inner space portions each delimiting an inner space such that, upon quarter turn rotation of the cap in opening direction by a user, the enlarged inner space portions align with the retention members as the retention members each move out of the respective window.

The closure assembly according to the second aspect of the invention may have one or more of the technical features described herein with reference to the first aspect of the invention.

As explained the embodiment of a long pin type cap as a quarter turn cap instead of the know threaded caps of this type is advantageous in view of injection molding, e.g. as it allows to use a single gate for injecting molten plastic into the cap mold arranged at the bottom end and bottom side of the hollow pin portion.

The second aspect of the invention also relates to a container provided with such a closure assembly.

A third aspect of the invention relates to a closure assembly comprising:

an article forming a tubular neck and having a product passage extending through said neck, said neck having a vertical axis and forming a mouth at a top end of said product passage, said neck having an interior side and an exterior side, a rotational cap having a unitary cap body that is injection molded of plastic material and that is secured on or to be secured on said neck of the article, the cap sealing the product passage in closed position of the cap on said neck, and the cap—for removal of the cap from the neck of the article by a user to open the product passage—being adapted to be manually rotated from the closed position in an opening direction, wherein the unitary cap body comprises a top wall having an outer perimeter, a downward depending skirt integral with said outer perimeter, wherein the cap and the article have at least one pair of cooperating sealing surfaces, wherein said skirt of the cap body has an interior side and an exterior side, wherein the cap furthermore comprises an integrally molded tamper-evident structure at the bottom end of the skirt which is adapted to evidence first time opening of the cap, characterized in that the bottom end of the skirt has a pair of diametrically opposed static cover portions separated from one another by a pair of diametrically opposed and open bottomed notches in said skirt, each of said static cover portions forming a sector of a lower edge of the skirt and having a leading rim and a trailing rim, seen in opening direction of the cap, preferably each static cover portion having a semi-circular inner contour about the vertical axis of the neck, wherein each notch is defined by an upper notch rim and by the trailing rim of one of the static cover portions and the leading rim of the other of the static cover portions, wherein in each notch an indicator segment of the tamper-evident structure is located, wherein each indicator segment is integrally molded to said upper notch rim by a non-frangible hinge, preferably a film hinge, and to each of said leading rim and said trailing rim via at least one respective frangible bridge, wherein each indicator segment has an inner face, and wherein the exterior side of the neck has for each indicator segment an integrally molded boss, said boss being engageable with the inner face of said segment, and wherein each boss is adapted to engage on said inner face of a respective indicator segment such that, upon first time opening of the cap by rotation in opening direction, the indicator segments are each forced outwardly by the respective boss such that each of said indicator segments pivots about said non-frangible hinge and said frangible bridges break, thereby said outwardly pivoted indicator segments and said broken frangible bridges evidencing the first time opening of the cap.

The closure assembly according to the third aspect of the invention may have one or more of the technical features described herein with reference to the first aspect of the invention.

As explained this provides for a highly remarkable tamper-evident, which can be readily combined in a mold with a long pin type cap, but may also be combined with caps lacking such a long pin.

The third aspect of the invention also relates to a container provided with such a closure assembly.

A fourth aspect of the invention relates to a closure assembly comprising:

an article forming a tubular neck and having a product passage extending through said neck, said neck having a vertical axis and forming a mouth at a top end of said product passage, said neck having an interior side and an exterior side, a rotational cap having a unitary cap body that is injection molded of plastic material and that is secured on or to be secured on said neck of the article, the cap sealing the product passage in closed position of the cap on said neck, and the cap—for removal of the cap from the neck of the article by a user to open the product passage—being adapted to be manually rotated from the closed position in an opening direction, wherein the unitary cap body comprises a top wall having an outer perimeter, a downward depending skirt integral with said outer perimeter, wherein the cap and the article have at least one pair of cooperating sealing surfaces, wherein said skirt of the cap body has an interior side and an exterior side, wherein the cap furthermore comprises an integrally molded tamper-evident structure at the bottom end of the skirt which is adapted to evidence first time opening of the cap, characterized in that the neck is provided with at least one integrally molded outwardly protruding retention member for the cap, wherein the skirt of the cap is provided, in a region above the tamper-evident structure, with at least one window that extends through the skirt, embodied to receive a retention member therein so as to axially retain the cap on the neck, and wherein the skirt of the cap has, at the level of said window, an enlarged inner space portion delimiting an inner space such that, upon less than full turn rotation of the cap in opening direction by a user, the enlarged inner space portion aligns with the retention member as the retention member moves out of the window, and in that the bottom end of the skirt has a pair of diametrically opposed static cover portions separated from one another by a pair of diametrically opposed and open bottomed notches in said skirt, each of said static cover portions forming a sector of a lower edge of the skirt and having a leading rim and a trailing rim, seen in opening direction of the cap, preferably each static cover portion having a semi-circular inner contour about the vertical axis of the neck, wherein each notch is defined by an upper notch rim and by the trailing rim of one of the static cover portions and the leading rim of the other of the static cover portions, wherein in each notch an indicator segment of the tamper-evident structure is located, wherein each indicator segment is integrally molded to one of said rims of the notch by a non-frangible hinge, preferably a film hinge, and to one or more of said other rims of the notch via at least one respective frangible bridge, wherein each indicator segment has an inner face, and wherein the exterior side of the neck has for each indicator segment an integrally molded boss, said boss being engageable with the inner face of said segment, and wherein each boss is adapted to engage on said inner face of a respective indicator segment such that, upon first time opening of the cap by rotation in opening direction, the indicator segments are each forced outwardly by the respective boss such that each of said indicator segments pivots about said non-frangible hinge and said frangible bridges break, thereby said outwardly pivoted indicator segments and said broken frangible bridges evidencing the first time opening of the cap.

The closure assembly according to the fourth aspect of the invention may have one or more of the technical features described herein with reference to the first aspect of the invention.

The closure assembly could in this arrangement have another number than two retention members, e.g. just one.

The fourth aspect of the invention also relates to a container provided with such a closure assembly.

A fifth aspect of the invention relates to a closure assembly, comprising:

an article forming a tubular neck and having a product passage extending through said neck, said neck having a vertical axis and forming a mouth at a top end of said product passage, said neck having an interior side and an exterior side, a rotational cap having a cap body that is secured on or to be secured on said neck of the article, the cap sealing the product passage in closed position of the cap on said neck, and the cap—for removal of the cap from the neck of the article by a user to open the product passage—being adapted to be manually rotated from the closed position in an opening direction, wherein the cap body comprises a top wall having an outer perimeter, a downward depending skirt integral with said outer perimeter, wherein the cap and the article have at least one pair of cooperating sealing surfaces, wherein said skirt of the cap body has an interior side and an exterior side, wherein the cap furthermore comprises an integrally molded tamper-evident structure at the bottom end of the skirt which is adapted to evidence first time opening of the cap, characterized in that the bottom end of the skirt has a pair of diametrically opposed static cover portions separated from one another by a pair of diametrically opposed and open bottomed notches in said skirt, each of said static cover portions forming a sector of a lower edge of the skirt and having a leading rim and a trailing rim, seen in opening direction of the cap, each static cover portion having a semi-circular inner contour about the vertical axis of the neck, wherein each notch is defined by an upper notch rim and by the trailing rim of one of the static cover portions and the leading rim of the other of the static cover portions, wherein in each notch an indicator segment of the tamper-evident structure is located, wherein each indicator segment is integrally molded to a rim of said notch by a non-frangible hinge, preferably a film hinge, and to one or more of said other rims of said notch via at least one respective frangible bridge, wherein each indicator segment has an inner face, wherein the neck comprises a pair of integrally molded, diametrically opposed semi-circular flange members, each flange member forming a boss, said boss being engageable with the inner face of said segment, wherein each flange member has a semi-circular outer perimeter of the flange member fitting within said a semi-circular inner perimeter of the static cover portion, e.g. wherein the semi-circular flange members have coplanar bottoms in a common radial plane and wherein said lower edge sectors formed by the static cover portions are located in said common radial plane, and wherein each boss is adapted to engage on said inner face of a respective indicator segment such that, upon first time opening of the cap by rotation in opening direction, the indicator segments are each forced outwardly by the respective boss such that each of said indicator segments pivots about said non-frangible hinge and said frangible bridges break, thereby said outwardly pivoted indicator segments and said broken frangible bridges evidencing the first time opening of the cap.

The closure assembly according to the fifth aspect of the invention may have one or more of the technical features described herein with reference to the first aspect of the invention.

As explained herein the flange members form on the one hand a substantial closure of the underside of the cap and also provide for internal support of the cover portions, which is beneficial in view of robustness of the closure assembly and the correct operation of the tamper-evident structure.

The fifth aspect of the invention also relates to a container provided with such a closure assembly.

A sixth aspect of the invention relates to a closure assembly comprising:

an article forming a tubular neck and having a product passage extending through said neck, said neck having a vertical axis and forming a mouth at a top end of said product passage, said neck having an interior side and an exterior side, a rotational cap having a cap body that is secured on or to be secured on said neck of the article, the cap sealing the product passage in closed position of the cap on said neck, and the cap—for removal of the cap from the neck of the article by a user to open the product passage—being adapted to be manually rotated from the closed position in an opening direction, wherein the cap body comprises an annular top wall having an inner perimeter and an outer perimeter, a downward depending skirt integral with said outer perimeter, and a hollow pin portion downward depending from said inner perimeter, said hollow pin portion having a circumferential face extending along a length thereof and a closed pin bottom, e.g. said hollow pin portion being open at a top thereof, wherein the circumferential face of the hollow pin portion and the article have at least one pair of cooperating sealing surfaces such that hollow pin portion, in the closed position cap, closes the product passage, wherein said skirt of the cap body has an interior side and an exterior side, wherein the cap furthermore comprises an integrally molded tamper-evident structure at the bottom end of the skirt which is adapted to evidence first time opening of the cap, wherein said hollow pin portion extends from the annular top wall downward at least to the level of the tamper-evident structure, wherein the hollow pin portion, near the bottom end thereof close to or adjoining the bottom end, has an outer annular bottom sealing surface, and wherein the article has a lower inner annular sealing surface that, in the closed position of the cap, sealing cooperates with said annular bottom sealing surface of the hollow pin portion, characterized in that the lower connector portion comprises a downward depending annular lip that forms said lower inner annular sealing surface.

As explained herein, the annular lip provides for enhanced quality of the seal onto the pin portion compared to a seal surface that is formed by a rigid seal boat or the like.

The closure assembly according to the sixth aspect of the invention may have one or more of the technical features described herein with reference to the first aspect of the invention.

The sixth aspect of the invention also relates to a container provided with such a closure assembly.

A seventh aspect of the invention relates to a closure assembly comprising:

an article forming a tubular neck and having a product passage extending through said neck, said neck having a vertical axis and forming a mouth at a top end of said product passage, said neck having an interior side and an exterior side, a rotational cap having a unitary cap body that is injection molded of plastic material and that is secured on or to be secured on said neck of the article, the cap sealing the product passage in closed position of the cap on said neck, and the cap—for removal of the cap from the neck of the article by a user to open the product passage—being adapted to be manually rotated from the closed position in an opening direction, wherein the cap body comprises an annular top wall, a downward depending skirt, and a hollow pin portion, said hollow pin portion having a circumferential face extending along a length thereof and a closed pin bottom, e.g. said hollow pin portion being open at a top thereof, wherein the circumferential face of the hollow pin portion and the article have at least one pair of cooperating sealing surfaces such that hollow pin portion, in the closed position cap, closes the product passage, wherein said skirt of the cap body has an interior side and an exterior side, wherein the cap furthermore comprises an integrally molded tamper-evident structure at the bottom end of the skirt which is adapted to evidence first time opening of the cap, wherein said hollow pin portion extends from the annular top wall downward at least to the level of the tamper-evident structure, characterized in that the cap is a quarter-turn cap, and in that the cap has been injection molded in an injection mold having a single gate that is arranged on the bottom side of the cavity portion that forms the closed bottom end of the hollow pin portion of the cap.

The closure assembly according to the seventh aspect of the invention may have one or more of the technical features described herein with reference to the first aspect of the invention.

The seventh aspect of the invention also relates to a container provided with such a closure assembly.

The invention, and any aspect thereof as well as combinations thereof, is discussed hereunder with reference to drawings of a non-limiting embodiment.

DETAILED DESCRIPTION OF EMBODIMENTS

Figure 1:
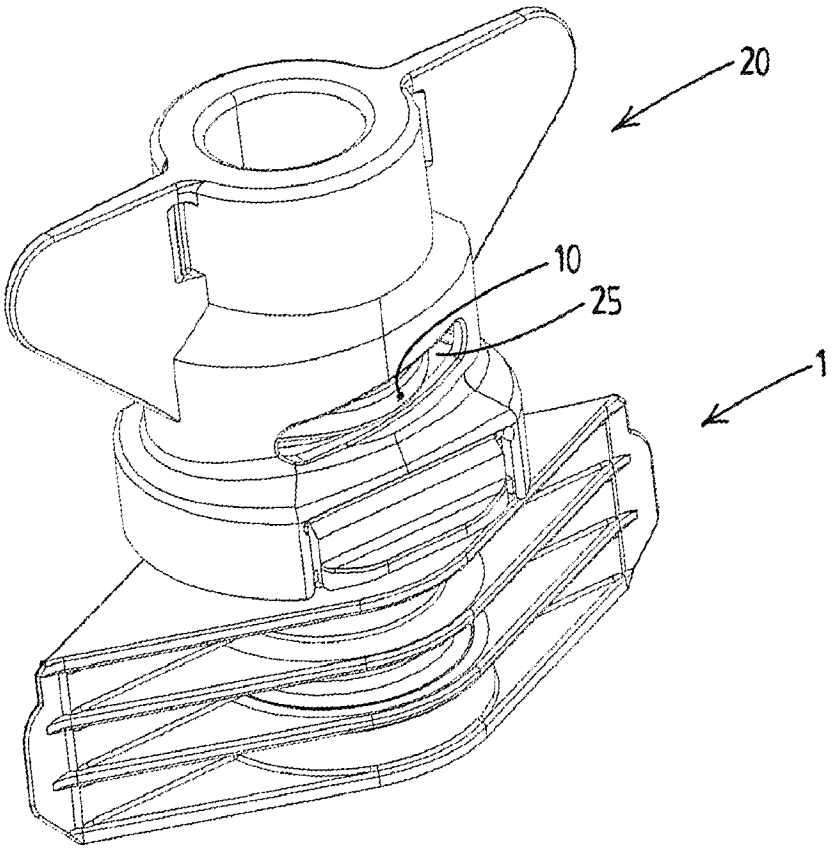
FIG. 1 shows a perspective view of an embodiment of the closure assembly according to the invention.

With reference to FIGS. 1-12 now a preferred embodiment of the closure assembly according to the invention will be discussed.

Reference numeral 1 denotes an article forming a tubular neck 2 around a product passage 3 in the article. The neck 2 forms a mouth at a top end of the product passage. The neck 2 has an exterior side.

The article 1 here comprises a lower connector portion 5 to be fastened to a container (not shown, e.g. a collapsible pouch).

In this example the article 1 is embodied as a spout with a connector portion that is adapted to be sealed between opposed film walls of a collapsible pouch container. The connector portion can have a different design, or even be absent, e.g. if the article is a container with an integral neck, e.g. a blow moulded bottle. The connector portion 5 here includes diametrically opposed fins 5*a*, 5*b* as is known in the art.

The tubular neck 2 here extends above the connector portion 5.

Reference numeral 20 denotes a rotational cap that is injection molded of plastic material.

The unitary cap body 20 comprises an annular top wall 21 having an inner perimeter and an outer perimeter, a downward depending skirt 22 that is integral with the outer perimeter, and a hollow pin portion 30 downward depending from the inner perimeter.

The hollow pin portion 30 has a circumferential face 31 extending along a length thereof and a closed pin bottom 32. As is preferred the hollow pin portion is open at a top thereof, but in an alternative a stopper member could be arranged in the hollow pin to close the open top.

The hollow pin portion 30 extends to below the lower edge of the skirt of the cap.

The cap furthermore comprises an integrally molded tamper-evident structure 40 at the bottom end of the skirt which is adapted to evidence first time opening of the cap 20.

The cap 20 is a quarter-turn cap.

In an embodiment the cap has different color than the spout 1.

The neck 2 is provided with two integrally molded and diametrically opposed, outwardly protruding retention members 10, 11 for the cap 20.

The skirt of the cap is provided, in a region above the tamper-evident structure 40, with two diametrically opposed windows 25, 26 that each extend through the skirt 22.

Each window, here embodied as a slot, is embodied to receive a retention member 10, 11 therein so as to axially retain the cap on the neck.

The skirt 22 of the cap has, at the level of the windows 25, 26, a pair of diametrically opposed enlarged inner space portions 27, 28 each delimiting an inner space 27*a*, 28*a* such that upon quarter turn rotation of the cap 20 in opening direction by a user, the enlarged inner space portions 27*a*, 28*a* align with the retention members 10, 11 as the retention members each move out of the respective window 25,26.

In other words the cap 20 has at the level of the windows 25, 26 therein has an ovate horizontal cross-section, with two diametrically opposed window regions where the windows 25, 26 are provided. These window regions are in contact with or closely spaced from the neck 2. Further there are two arctuate enlarged inner dimension regions that have a major distance exceeding the outer diameter of the neck 2 so as the leave an intermediate space 27*a*, 28*a* that can receive a respective retention member 10, 11 when the cap is rotated by a user over about a quarter turn. Each intermediate space is open towards the lower edge of the cap 20 so as to allow lifting of the quarter turned cap 20 in order to remove the cap from the neck 2.

The interior of the skirt 22 and the exterior of the hollow pin portion 30 are devoid of any threading, allowing their formation by an annular portion of an injection mold core member that is solely axially moved relative to the cap 20 in the course of ejection of the molded cap.

The bottom end of the skirt 22 has a pair of diametrically opposed static cover portions 23, 24 separated from one another by a pair of diametrically opposed and open bottomed notches 33, 34 in said skirt.

Each of said static cover portions 23, 24 form a sector of a lower edge of the skirt 22 and have a leading rim and a trailing rim, seen in opening direction of the cap. As is preferred, each static cover portion has a semi-circular inner contour about the vertical axis 4 of the neck 2.

Each notch 33, 34 is defined by an upper notch rim and by the trailing rim of one of the static cover portions and the leading rim of the other of the static cover portions.

In each notch an indicator segment 41, 42 of the tamper-evident structure is located.

Each indicator segment 41, 42 is integrally molded to the upper notch rim by a non-frangible hinge, here as preferred a film hinge 43,44, and to each of said leading rim and said trailing rim via at least one respective frangible bridge 45, 46, 47, 48.

Each indicator segment has an inner face, and the exterior side of the neck 2 has for each indicator segment an integrally molded boss 12, 13. This boss 12, 13 is engageable with the inner face of the indicator segment 41, 42

Each boss 12, 13 is adapted to engage on the inner face of a respective indicator segment 41, 42 such that, upon first time opening of the cap 20 by quarter turn rotation in opening direction, the indicator segments 41, 42 are each forced outwardly by the respective boss 12, 13 such that each of said segments 41, 42 pivots about said non-frangible hinge and said frangible bridges break, thereby said outwardly pivoted indicator segments and said broken frangible bridges 45, 46, 47, 48 evidencing the first time opening of the cap 20. As illustrated each indicator segment 41, 42 is elongated with a length in direction between the trailing rim and leading rim of the respective notch and a height in vertical direction.

The film hinge extends over a major portion, so at least 50%, of the length of the segment 41, 42. Here, as is preferred in view of maximum pull strength, the film hinge 43, 44 extends over approximately the entire length of the respective segment.

The design of the hinges 43, 44, preferably film hinges, is such that they afford a pulling strength of at least 90N when subjected at 20° C., e.g. after first time opening of the cap, to a pulling force in the plane of the indicator segment 41, 42 and perpendicular to the hinge extension. As is preferred this test is performed with the cap having been opened, so the frangible bridges broken and the film hinge having pivoted at least once.

As illustrated here each indicator segment 41, 42 is connected to each of the associated trailing leading rims via a single frangible bridge 45-48, here formed each by a single frangible rod portion. These bridges are located close to the lower edge of the respective static cover portion, so remote from the film hinge.

Figure 2:
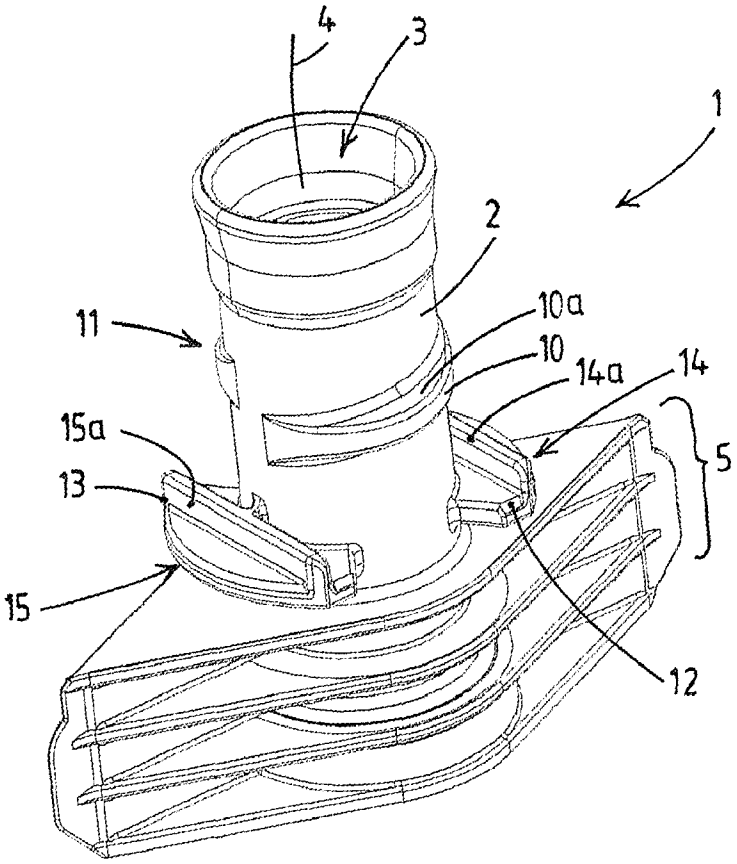
FIG. 2 shows the spout of the assembly of FIG. 1 with the cap removed.
Figure 3:
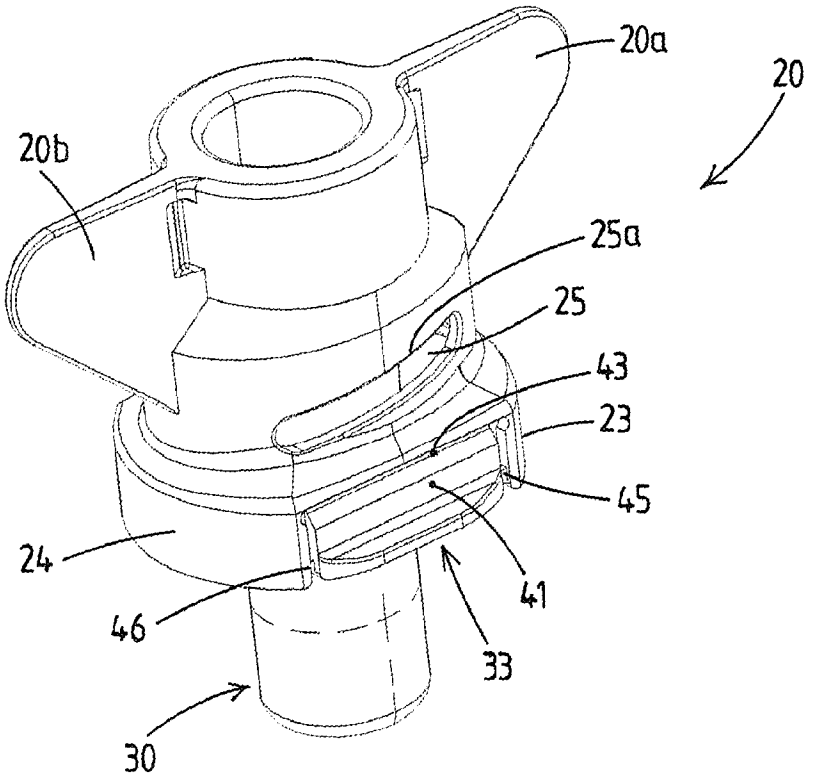
FIG. 3 shows the cap of the assembly of FIG. 1, FIGS. 4*a*, 4*b* show the cap of FIG. 3 in two views from below, FIGS. 5*a, b* show the cap of FIG. 3 in two orthogonal vertical cross-sections.
Figure 4A:
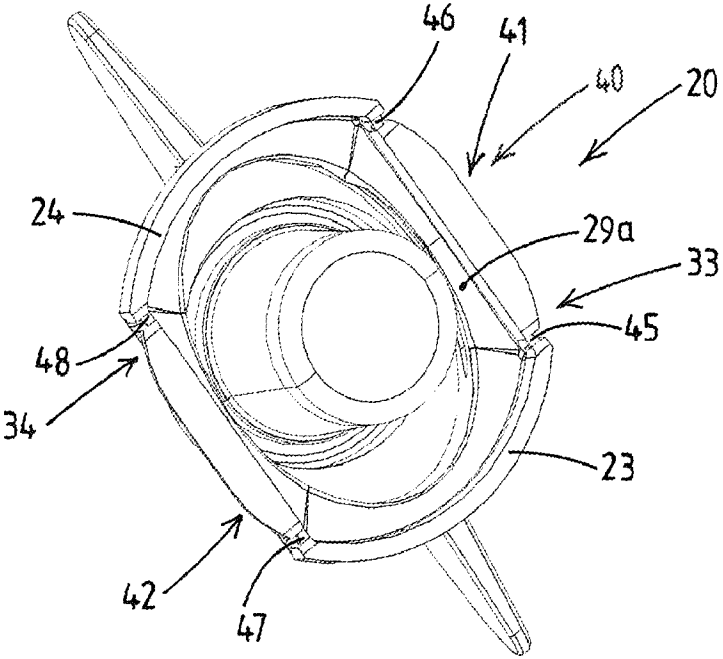
Figure 4B:
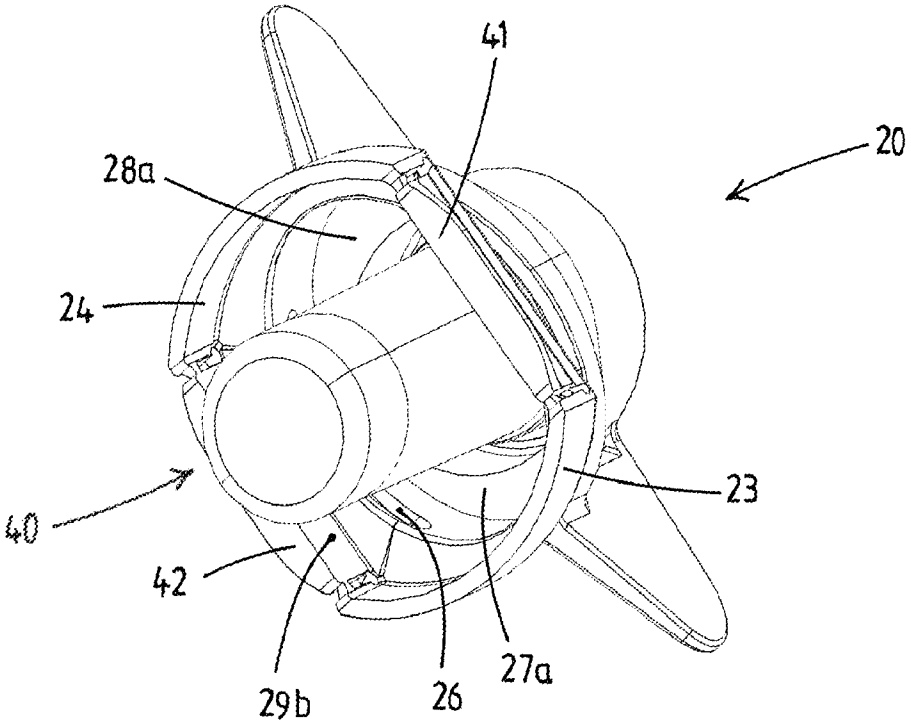
Figure 5A:
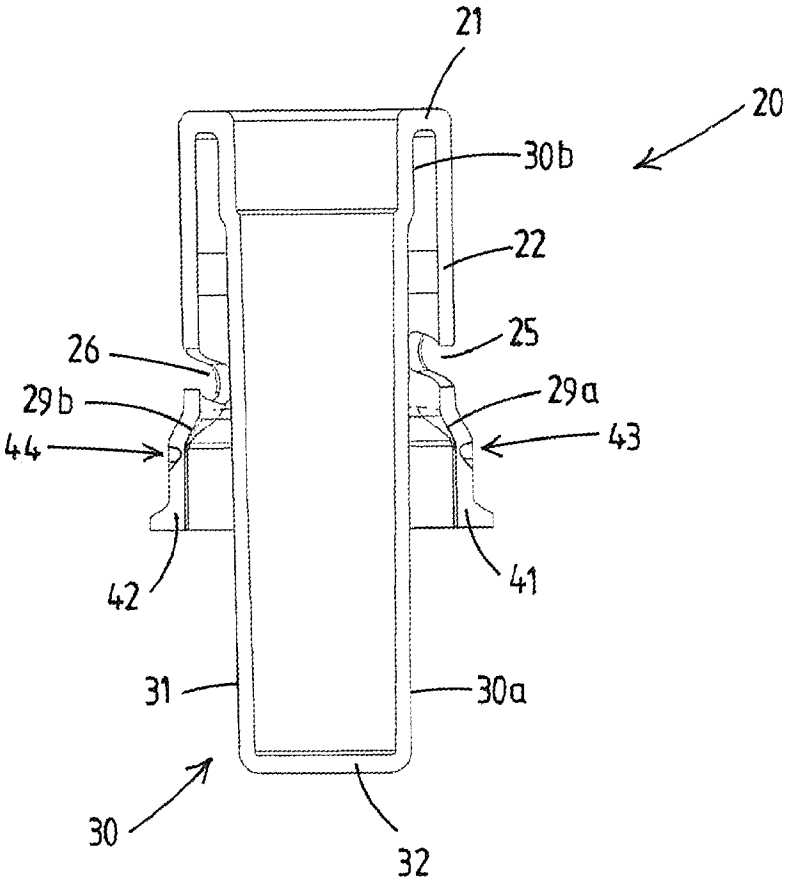
Figure 5B:
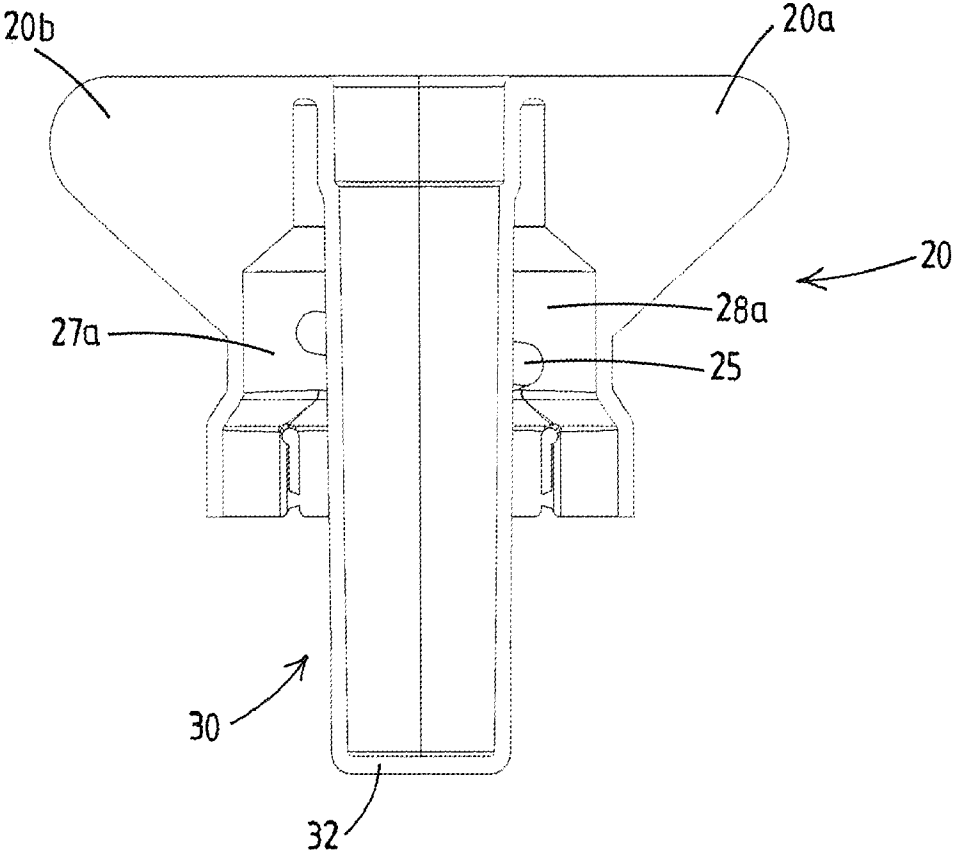
Figure 6:
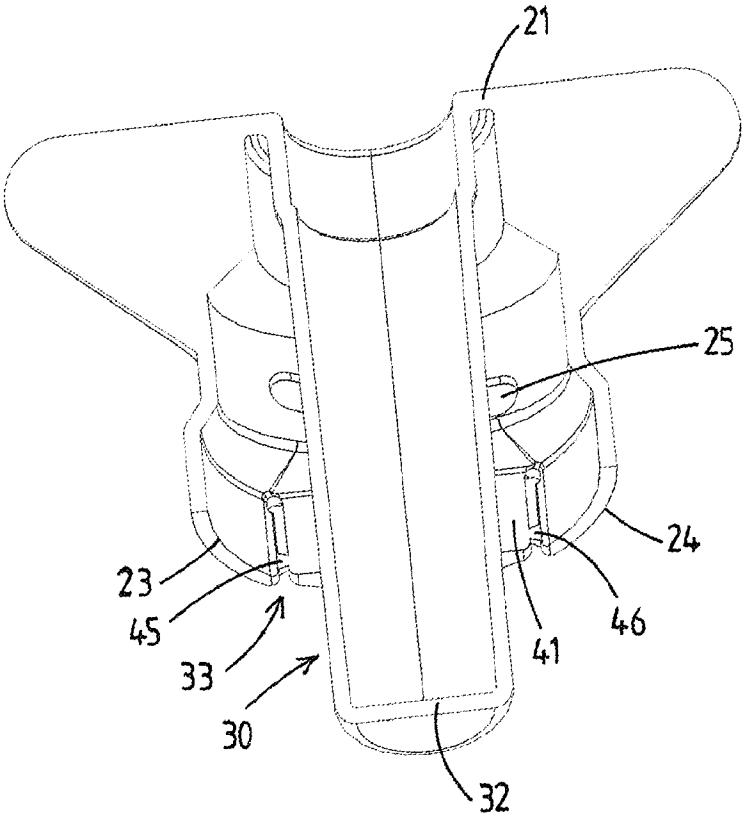
FIG. 6 shows the cap of FIG. 3 cut in half through a vertical midplane.

As can be seen in FIG. 2 the neck 2 comprises a pair of integrally molded, diametrically opposed semi-circular flange members 14, 15. These flanges 14, 15 extend in a horizontal plane, radially outward from the neck 2, each over a sector of the circumference of the neck.

Each flange member 14, 15 forms one of the bosses 12, 13.

Each flange member 14, 15 has a semi-circular outer perimeter, effectively matching the semi-circular inner contour of a cover portion 23, 24 of the cap 20. As can be seen in e.g. FIG. 7, each static cover portion 23, 24 has a semi-circular inner perimeter fitting around the semi-circular outer perimeter of the flange member 14, 15, e.g. with a narrow gap in between.

Figure 7:
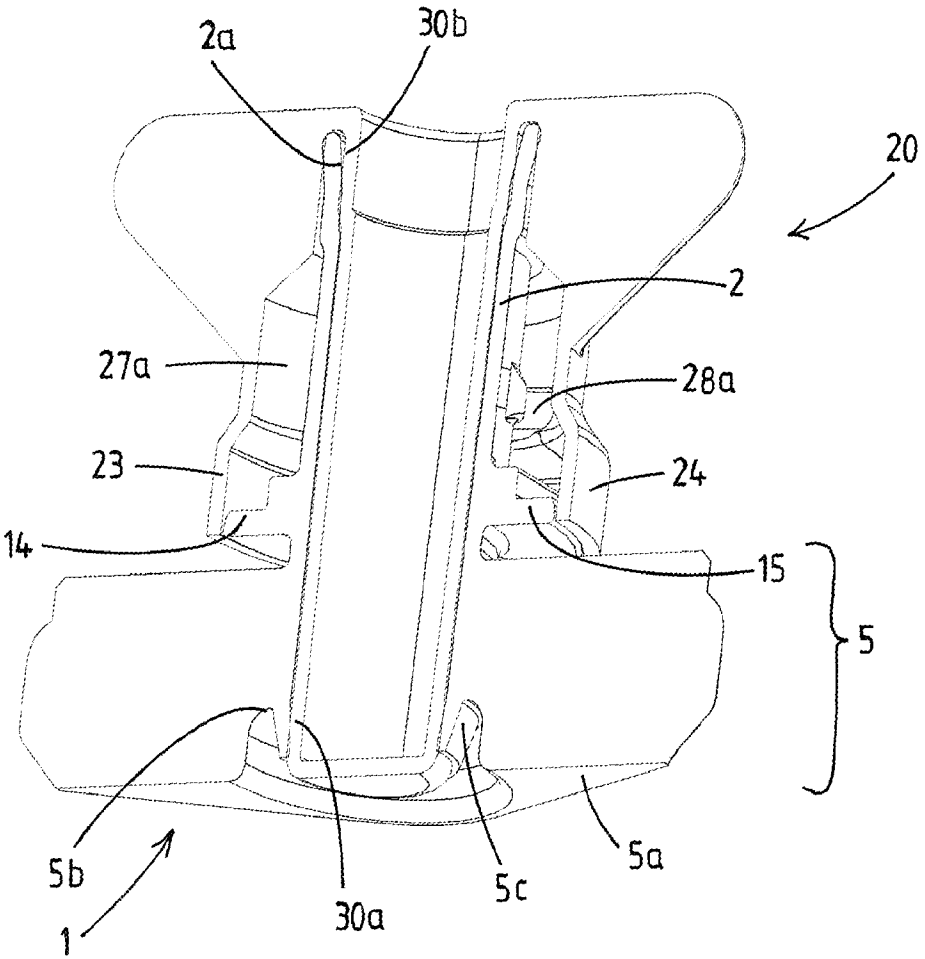
FIG. 7 shows the assembly of FIG. 1 cut in half through said vertical midplane.

Also, as shown in FIG. 7, these semi-circular flange members 14, 15 have coplanar bottoms in a common radial plane and the lower edge sectors formed by the static cover portions are located in this common radial plane. Also the segments 41, 42 have their lower edge in said plane, so that the flange members 14, 15 support, inwardly, both the segments and the static cover portions at their lower edge.

Figure 8:
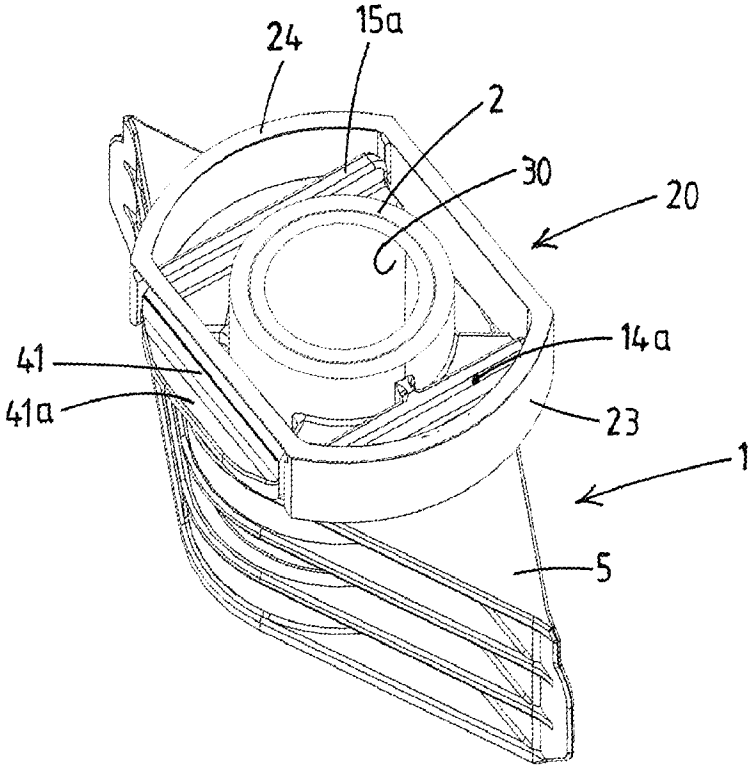
FIG. 8 shows a horizontal cross-section of the assembly of FIG. 1 just above the tamper evident structure.
Figure 9:
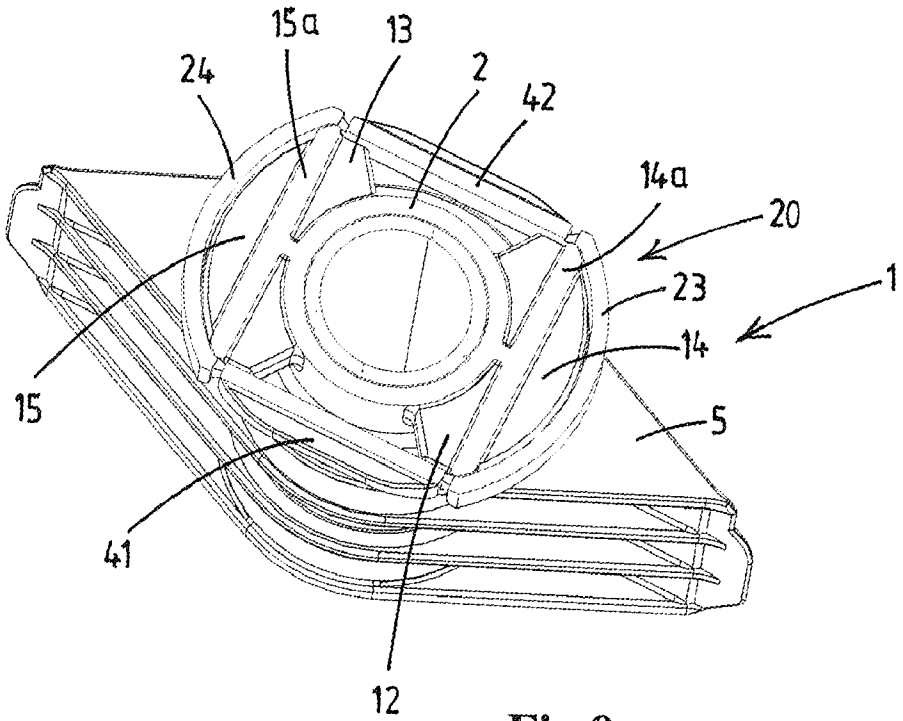
FIG. 9 shows a horizontal cross-section of the assembly of FIG. 1 just above the frangible bridges holding the tamper-evident segments.
Figure 10:
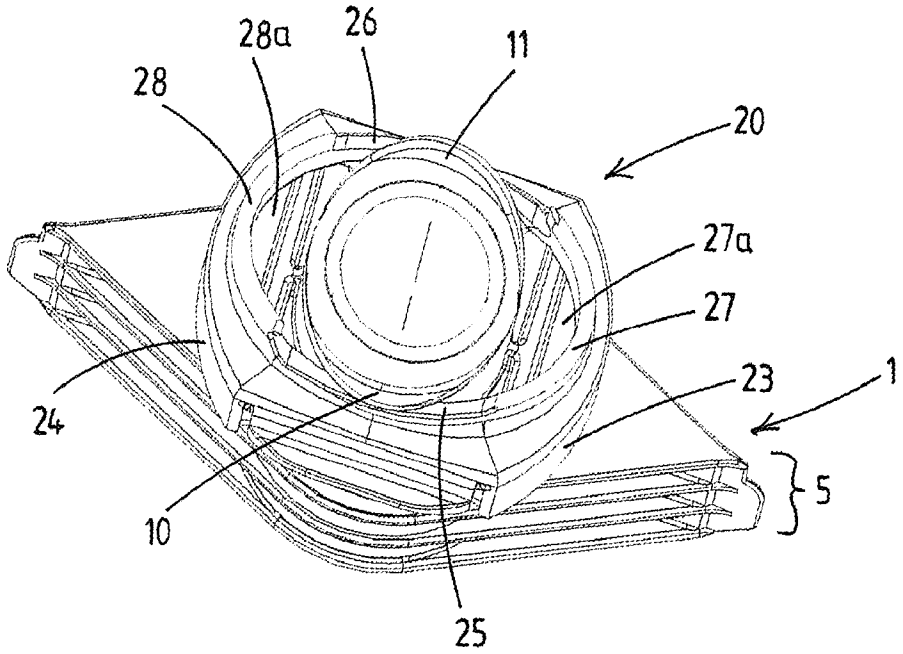
FIG. 10 shows a horizontal cross-section of the assembly of FIG. 1 at the level of the retention members that are received in their respective slotted windows, FIGS. 11*a, b* show the spout of FIG. 2 in two orthogonal vertical cross-sections.
Figure 11A:
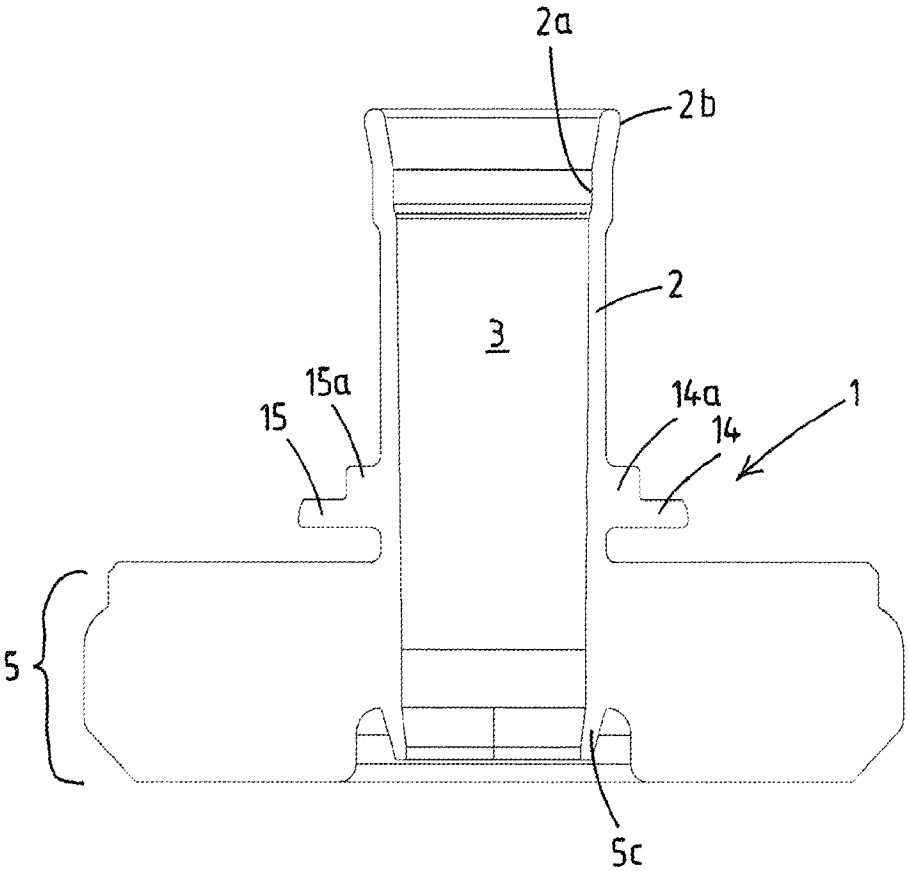
Figure 11B:
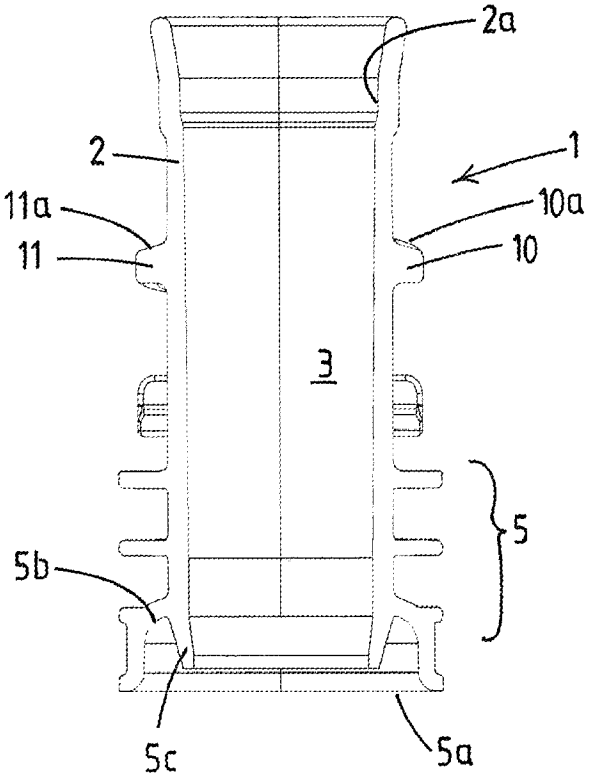

As illustrated in FIGS. 2, 8, and 9 a rectilinear rib portion 14*a*, 15*a* is present on top of each flange member 14, 15, here essentially perpendicular to the respective indicator segments 41, 42.

The rectilinear rib portions 14*a*, 15*a* of the opposed flange members 14, 15 are parallel to one another and extend over the width of the respective flange member 14, 15 so as to have rib ends of which one forms said boss 12, 13 and is located directly inward of an indicator segment 41, 42. Here, is preferred, each boss end of such a rib 14*a*, 15*a* is located directly inward of an end portion of a segment 41, 42 in the closed position of the cap 20. This causes the segment 41, 42 to be directly pressed outward by the boss when the user starts to turn the cap in opening direction, with said load being first focused near the leading frangible bridge which will then break. The other frangible bridge will also become stressed and break whilst the segment will pivot about the upper hinge 43, 44 thereof as in the further turning of the cap the boss will continue to press the segment outwards.

The outward pivoting about their upper edges of the pair of indicator segments 41, 42, generally on opposite sides of the cap 20, is highly visible for the consumer and thus provides an attractive tamper-evident.

As can be seen the neck 2 is devoid of any additional flanges between the flange members 14, 15 and the lower connector portion 5, allowing a close spacing between the flange members 14, 15 and the portion 5. For example the flange members 14, 15 and the top face of the portion 5 form parallel guide surfaces, e.g. for sliding the spout onto a C-shaped rail or between guide members in spout handling equipment.

To enhance the strength of the indicator segment, e.g. in view the desired breaking of the frangible bridges, the each indicator segment has, at the exterior of the segment, a reinforcing rib portion 41*a*, 42*a* extending along a lower edge of the segment.

As illustrated here, the retention members 10, 11 each are embodied with an inclined upper ramp face 10*a*, 11*a*, and an approximately parallel inclined bottom face. The windows 25, 26 are embodied as inclined slotted windows, each having an upper edge that forms a mating inclined ramp face 25*a*, so that upon rotating the cap in opening direction, the ramp faces of a retention member 10, 11 cooperate and provide a lift action of the cap relative to the neck. This lift force may be of use to disengage the one or more seals between the cap and the article, and/or to disengage any snap connection between them.

It will be appreciate that in case such lift effect is not desired, the windows could be horizontal with the retention members lacking a lift effect ramp face.

As illustrated the windows 25, 26 are arranged vertically above the indicator segments 41, 42. This is effective in view of molding the cap and for the strength of the cap. Also it is illustrated that the enlarged inner space portions 27, 28 of the skirt are located vertically above the static cover portions 23, 24.

As will be appreciated the indicator segments 41, 42 are radially spaced further from the vertical axis 4 of the neck 2 than the windows 25,26 arranged there above. This arrangement allows for vertical placement of the cap on the neck, with retention members snapping into the windows without placing strain on the indicator segments, e.g. the segments being located further away from the neck than the radial extension of the retention members 10, 11.

As illustrated the skirt 22 comprises an inner guide face 29*a, b* in a region of its interior between the upper rim of each of the notches and the window there above. These inner guide faces 29*a, b* are each upwardly and inwardly inclined thereby facilitating an axial snap fitting of the cap 20 on the neck such that the retention member 10, 11 snaps into the respective window 25, 26.

As illustrated, in order to enhance grip on the cap and/or to enhance anti-choke properties of the cap 20, the cap has two diametrically opposed, substantially planar wing portions 20*a, b* that extend outwardly from the skirt 22 in an imaginary vertical plane through the vertical axis the neck.

As illustrated the pair of windows 25, 26 and the pair of indicator segments 41, 42 are located on diametrically opposed locations relative to this imaginary vertical plane through the wing portions 20*a, b* of the cap. This is effective in view of injection molding and of strength of the cap.

As illustrated, e.g. in FIG. 9, when seen from above, each flange member 14, 15 extends over an arctuate sector of the neck 2 with the semicircular outer perimeter thereof fitting within a matching semicircular static cover portion of the cap. Also the flange members 14, 15 each extend to overlap with an end portion of an indicator segment 41, 42 only, so as to leave a central portion of the segment 41, 42 inwardly unsupported.

In an alternative design the neck is provided with a single flange member extending fully around the neck 2, the flange member having two opposed semi-circular outer perimeter sectors matching the semi-circular static cover portions 23, 24 of the cap 20. For example the flange than has a pair of substantially parallel opposed straight faces, each to lie along the inside of an indicator segment 41, 42.

As illustrated the spout 1 has a lower connector portion 5 that is adapted to be secured between opposed film walls of a collapsible pouch container. The product passage 3 extends through the lower connector portion 5 as a continuation of the passage through the neck.

As illustrated it is preferred for a seal to be present close to the lower end, or bottom end, of the product passage so that no packaged product will be present in the closed passage and in order to obtain a maximum barrier effect, e.g. in view of penetration of oxygen through the article 1.

The depicted lower connector portion is known in the art as a rigid sealboat, here with a central column portion and multiple horizontal plates spaced vertically and interconnected by a vertical plate. This results in a rather rigid lower connector portion.

The lower connector portion 5 has a bottom face 5*a*, here horizontal and planar and formed by the lowermost plate, and recessed central region 5*b* that lies higher than said bottom face 5*a*.

An annular sealing lip 5*c* around the product passage depends from this recessed central region 5*b*, not beyond the level of the bottom face 5*a* so that the lip 5*c* is effectively hidden and unlikely to become damaged in handling of the spout 1, e.g. in a conveyor to a sealing machine.

The lip 5*c* forms a lower inner annular sealing surface that, in closed position of the cap, cooperates with the hollow pin portion 30, near the bottom end thereof close to or adjoining the bottom end, which has an outer annular bottom sealing surface 30*a*.

The external bottom corner of the hollow pin portion 30 is rounded, e.g. so as to avoid sharp edge that may be detrimental to any sealing surface at the interior of the neck and/or channel when pressing the cap onto the neck, e.g. of the lip 5*c*.

The hollow pin portion 30 also has, near a top end thereof close to or adjoining the annular top wall 21 of the cap, an outer annular top sealing surface 30*b*, here of greater diameter than the lower sealing surface 30*a* portion of the hollow pin as well as any lower section of the pin portion.

The neck 2 has at a top region thereof at top inner annular sealing surface 2*a* that, in the closed position of the cap, sealing cooperates with said outer annular top sealing surface 30*b* of the hollow pin.

Figure 12:
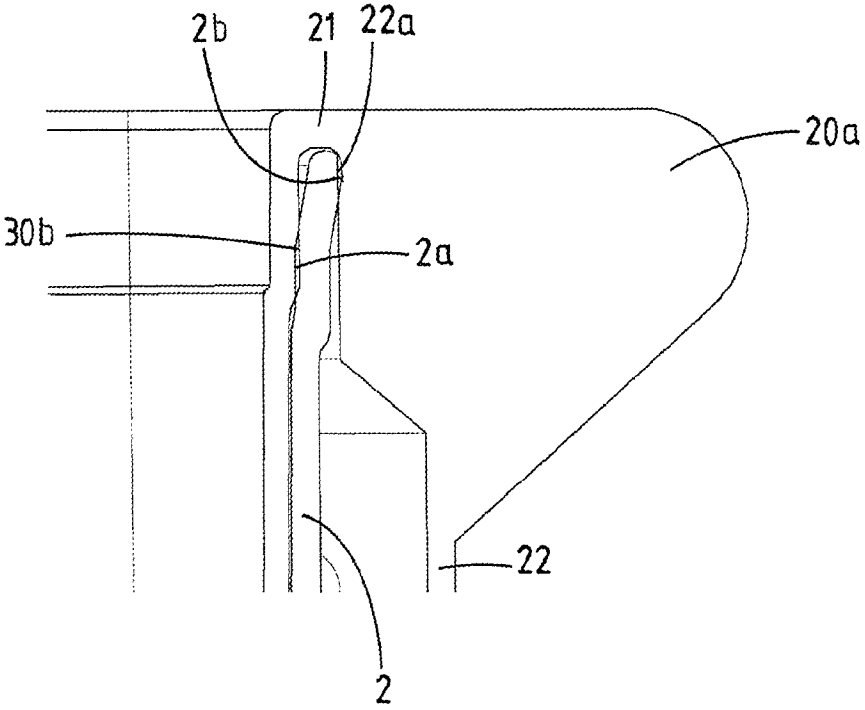
FIG. 12 shows in detail the seals between the cap of the neck of the closure assembly of FIG. 1.

As a further seal, the neck 2 has at a top region thereof, above the retention members 10, 11, an outer annular sealing surface 2*b* that, in the closed position of the cap, sealing cooperates with an associated inner annular sealing surface 22*a* at the interior of the skirt of the cap, see e.g. FIG. 12.

It will be appreciated that instead of having a sealboat the lower connector portion could, e.g. also be embodied as a radial circular seal flange, e.g. as is common for sealing onto a panel of a container, e.g. onto the film wall panel of a pouch. The lower connector portion could also be embodied to be secured in another fitment that is secured onto a container.

It will be appreciated that the illustrated cap 20 and spout 1 can be made by injection molding using suitable plastic materials. The cap can then be secured on the neck by snap fitting the cap in linear vertical motion onto the neck.

As is preferred, and greatly facilitated at least by the absence of threading in the cap 20, it is envisaged that the cap is injection molded in an injection mold having a single gate that is arranged on the bottom side of the cavity portion that forms the closed bottom end 31 of the hollow pin portion 30 of the cap.

In view of the desire to achieve a high pull strength of the indicator segments it is proposed that one or more injection molded caps are taken as samples from a batch, wherein the indicator segments of said samples are moved to their outwardly and upwardly pivoted position, and wherein said indicator segments are subjected to a test load of 90N in a direction perpendicular to the hinge in the plane of the segment, optionally both in initially position of the segment (e.g. with the frangible bridges broken) and in said outwardly pivoted position, e.g. subjecting said indicator segments first to multiple pivoting motions prior to testing, and wherein said batch is discarded if said test is not met due to one or more indicator segments become separated from the cap.

What is claimed is:

1. A closure assembly comprising:

an article forming a tubular neck and having a product passage extending through said neck, said neck having a vertical axis and forming a mouth at a top end of said product passage, said neck having an interior side and an exterior side, a rotational cap having a unitary cap body that is injection molded of plastic material, the cap to be secured on said neck of the article, the cap sealing the product passage in a closed position of the cap on said neck, wherein for removal of the cap from the neck of the article by a user to open the product passage the cap is adapted to be manually rotated from the closed position in an opening direction, wherein the unitary cap body comprises an annular top wall having an inner perimeter and an outer perimeter, a downward depending skirt integral with said outer perimeter, and a hollow pin portion downward depending from said inner perimeter and having a circumferential face extending along a length thereof as well as a closed pin bottom, wherein the circumferential face of the hollow pin portion and the article have at least one pair of cooperating sealing surfaces such that the hollow pin portion, in the closed position of the cap, closes the product passage, wherein said skirt of the cap body has an interior side and an exterior side, wherein the cap furthermore comprises an integrally molded tamper-evident structure at a bottom end of the skirt which is adapted to evidence a first time opening of the cap, wherein said hollow pin portion extends from the annular top wall downward at least to a level of the tamper-evident structure, wherein the cap is a quarter-turn cap, wherein the neck is provided with two integrally molded and diametrically opposed, outwardly protruding retention members for the cap, wherein the skirt of the cap is provided, in a region above the tamper-evident structure, with two diametrically opposed windows that each extend through the skirt, each window being embodied to receive one of said retention members therein so as to axially retain the cap on the neck, wherein the skirt of the cap has, at a level of said windows, a pair of diametrically opposed enlarged inner space portions each delimiting an inner space such that, upon a quarter turn rotation of the cap in said opening direction by the user, the enlarged inner space portions align with the retention members as the retention members each move out of the respective window, wherein a bottom end of the skirt has a pair of diametrically opposed static cover portions separated from one another by a pair of diametrically opposed and open bottomed notches in said skirt, each of said static cover portions forming a sector of a lower edge of the skirt and having a leading rim and a trailing rim, seen in the opening direction of the cap, wherein each notch is defined by an upper notch rim and by the trailing rim of one of the static cover portions and the leading rim of the other of the static cover portions, wherein in each of said notch an indicator segment of the tamper-evident structure is located, which is integrally molded to said upper notch rim by a non-frangible hinge, wherein the indicator segments are integrally molded to each of said leading rim and said trailing rim via at least one respective frangible bridge, wherein the indicator segments have an inner face, and wherein the exterior side of the neck has for the indicator segments an integrally molded boss, said boss being engageable with the inner face of said indicator segment, and wherein the bosses are adapted to engage on said inner face of a respective indicator segment such that, upon the first time opening of the cap by the quarter turn rotation in said opening direction, the indicator segments are each forced outwardly by the respective boss such that each of said indicator segments pivots about said non-frangible hinge and said frangible bridges break, thereby said outwardly pivoted indicator segments and said broken frangible bridges evidencing the first time opening of the cap.

2. The closure assembly according to claim 1, wherein the indicator segments are elongated with a length in direction between said trailing and said leading rim of the notch and a height, wherein the hinge is embodied as a film hinge which extends over a portion of the length of the indicator segments.

3. The closure assembly according to claim 1, wherein the hinge provides a pulling strength of at least 90N when subjected at 20° C. after the first time opening of the cap to the pulling force in a plane of the segment and perpendicular to the hinge.

4. The closure assembly according to claim 1, wherein the indicator segments are connected to each of the associated trailing rims via a single frangible bridge.

5. The closure assembly according to claim 1, wherein the neck comprises a pair of integrally molded, diametrically opposed semi-circular flange members, each forming one of said bosses, wherein each flange member has a semi-circular outer perimeter, and wherein each static cover portion has a semi-circular inner perimeter fitting around said semi-circular outer perimeter of the flange member.

6. The closure assembly according to claim 5, wherein a rib portion is present on top of each flange member, and wherein said rib portions of the opposed flange members are parallel and extend over a width of the respective flange member so as to have rib ends of which one rib forms said boss and is located directly inward of the indicator segments.

7. The closure assembly according to according to claim 1, wherein the indicator segments have a lower edge located in a common radial plane with the lower edge sectors formed by the static cover portions.

8. The closure assembly according to claim 1, wherein the indicator segments have, at an exterior of the segments, a reinforcing rib portion extending along a lower edge of the indicator segments.

9. The closure assembly according to claim 1, wherein the retention members each have an inclined ramp face, and wherein said windows each have a mating inclined ramp face, so that upon rotating the cap in the opening direction, said ramp faces of the retention members and the windows cooperate and provide a lift action of the cap relative to the neck.

10. The closure assembly according to claim 1, wherein the windows are arranged vertically above the indicator segments, and wherein the enlarged inner space portions of the skirt are located vertically above the static cover portions, and wherein the skirt comprises an inner guide face in a region of the interior of the skirt between the upper rim of the notch and the window there above, said inner guide face being upwardly and inwardly inclined thereby facilitating an axial snap fitting of the cap on the neck such that the retention member snaps into the window.

11. The closure assembly according to claim 1, wherein the cap has two diametrically opposed, substantially planar wing portions that extend outwardly from the skirt in an imaginary vertical plane through the vertical axis of the neck, said wing portions at least one of enhancing grip on the cap by the user and enhancing anti-choke hazard properties of the cap.

12. The closure assembly according to claim 10, wherein the cap has two diametrically opposed, substantially planar wing portions that extend outwardly from the skirt in an imaginary vertical plane through the vertical axis of the neck, said wing portions at least one of enhancing grip on the cap by the user and enhancing anti-choke hazard properties of the cap, and wherein said windows and said indicator segments are located on diametrically opposed locations relative to said imaginary vertical plane through the wing portions of the cap.

13. The closure assembly according to claim 5, wherein, when seen from above, each flange member extends over an arctuate sector of the neck with the semicircular outer perimeter thereof fitting within a matching semicircular static cover portion of the cap, wherein said flange members each extend to overlap with an end portion of the indicator segments only, so as to leave a central portion of the indicator segments inwardly unsupported.

14. The closure assembly according to claim 1, wherein the neck has at a top region thereof, above the retention members, outer annular sealing surface that, in the closed position of the cap, sealing cooperates with an associated inner annular sealing surface at the interior of the skirt of the cap.

15. The closure assembly according to claim 1, wherein the hollow pin portion, near a top end thereof close to or adjoining the annular top wall of the cap, has an outer annular top sealing surface, and wherein the neck has, at a top region thereof, a top inner annular sealing surface that, in the closed position of the cap, sealing cooperates with said outer annular top sealing surface of the hollow pin portion.

16. The closure assembly according to claim 1, wherein the hollow pin portion, close to or adjoining the closed pin bottom, has an outer annular bottom sealing surface, and wherein the article has a lower inner annular sealing surface that, in the closed position of the cap, sealing cooperates with said annular bottom sealing surface of the hollow pin portion.

17. The closure assembly according to claim 1, wherein said article is a spout having a lower connector portion to be secured between opposed film walls of a collapsible pouch container, and wherein the product passage extends through said lower connector portion and aligned with said neck as a downward continuation thereof to a lowermost channel opening.

18. The closure assembly according to claim 16, wherein said article is a spout having a lower connector portion adapted to be secured between opposed film walls of a collapsible pouch container, and wherein the product passage extends through said lower connector portion and aligned with said neck as a downward continuation thereof to a lowermost channel opening, and wherein the lower connector portion comprises a downward depending annular lip that forms said lower inner annular sealing surface, wherein the lower connector portion has a bottom face and a recessed central region that lies higher than said bottom face, wherein said annular lip depends from said recessed central region.

* * * * *